United States Patent [19]

Zavaras et al.

[11] 3,995,678

[45] Dec. 7, 1976

[54] INDUCTION STIRRING IN CONTINUOUS CASTING

[75] Inventors: Alexander A. Zavaras, Broadview Heights; Robert E. Ryan, Highland Heights, both of Ohio

[73] Assignee: Republic Steel Corporation, Cleveland, Ohio

[22] Filed: Feb. 20, 1976

[21] Appl. No.: 659,947

[52] U.S. Cl. ..... 164/49; 164/82; 164/147; 164/250; 164/273 R; 164/283 M

[51] Int. Cl.[2] ..... B22D 27/02

[58] Field of Search ..... 164/48, 49, 82, 146, 164/147, 250, 251, 273 R, 283 R, 283 M

[56] References Cited

UNITED STATES PATENTS

| | | | |
|---|---|---|---|
| 3,693,697 | 9/1972 | Tzavaras | 164/147 X |
| 3,804,147 | 4/1974 | Babel et al. | 164/147 X |
| 3,811,490 | 5/1974 | Middleton et al. | 164/82 X |

FOREIGN PATENTS OR APPLICATIONS

| | | | |
|---|---|---|---|
| 531,772 | 10/1956 | Canada | 164/283 R |
| 173,173 | 11/1960 | Sweden | 164/40 |
| 705,762 | 3/1954 | United Kingdom | 164/283 M |

*Primary Examiner*—Ronald J. Shore
*Attorney, Agent, or Firm*—Cooper, Dunham, Clark, Griffin & Moran

[57] ABSTRACT

In continuous casting of a metal ingot which undergoes solidification progressively inwardly from its periphery while advancing through and beyond an open-ended mold, with induction stirring of the molten interior of the ingot effected by a moving magnetic field acting on the ingot throughout a stirring zone in the path of ingot advance so as to produce longitudinally directed metal flow, the applied stirring force is caused to diminish progressively and continuously toward at least one extremity of the stirring zone.

19 Claims, 9 Drawing Figures

INDUCTION STIRRING IN CONTINUOUS CASTING

BACKGROUND OF THE INVENTION

This invention relates to the continuous casting of metal, and more particularly to continuous casting procedures and apparatus providing induction stirring within the molten interior of a solidifying ingot as the ingot is cast.

In connection casting as herein contemplated, the metal being cast is progressively advanced through and beyond a chilled, open-ended mold while undergoing peripheral solidification to provide a solid outer shell for the emerging cast body, which typically has a core or central pool of molten metal extending for a considerable distance beyond the mold. Within the emerging ingot, then, there is a solid-liquid interface that tapers progressively toward the center of the ingot in a downstream direction (away from the mold) along the path of ingot advance. Additional positive cooling is commonly applied to the ingot body beyond the mold to promote solidifiction of the ingot interior. As casting proceeds, fresh molten metal is supplied to the mold so that a continuous, elongated ingot or strand is produced. It has heretofore been recognized that induction stirring of molten metal in the central pool of the solidifying ingot has a beneficial effect on ingot microstructure and thereby contributes to reduction or control of such problems as segregation, centerline porosity or shrinkage, and columnar growth in the ingot. In particular, as disclosed in U.S. Pat. No. 3,693,697 (issued Sept. 26, 1972 to Alexander A. Tzavaras, one of the applicants herein), these results are achieved by producing, throughout a stirring zone or region in the path of ingot advance beyond the mold, a moving magnetic field that causes a flow or current of molten metal to sweep along the solid-liquid interface within the ingot in a first longitudinal direction (i.e. a direction parallel to the path of ingot advance) and to return along the center of the ingot in a reverse longitudinal direction. That is to say, an alternating current field in produced adjacent the ingot in the stirring region, for example by energizing a helical coil (extending through the stirring region in surrounding relation to the ingot) with alternating current supplied to have at least two successively different phases in longitudinally successive portions of the stirring region, so as to move the molten metal within the ingot along the described flow path, in accordance with known principles of induction stirring.

It is found, however, that such induction stirring may result in undesired localized segregation of interstitials (e.g. C and S) and of inclusion-forming elements (e.g. Al and Mn, in steel ingots), especially if the stirring region is relatively short. For instance, in an illustrative steelcasting operation with induction stirring provided by a helical coil, use of a three-foot-long coil may cause localized segregation while use of a twenty-foot-long coil, under otherwise comparable operating conditions, does not cause segregation. It would be desirable to achieve assured control or elimination of this segregation problem without regard to stirring region length, at least over a wide range of lengths, and in particular to enable use of a relatively short stirring region (as is frequently advantageous for reasons including economy and convenience) without causing excessive localized segregation.

SUMMARY OF THE INVENTION

The present invention broadly embraces the discovery that localized segregation, in continuously cast metal ingots, subjected to induction stirring as described above, is caused by abrupt initiation and termination of stirring at the ends of the sitrring region; and that such segregation may be satisfactorily controlled or even eliminated by effecting a smooth and gradual diminution in the applied stirring force toward at least one extremity (in most cases, preferably toward both extremities) of the stirring region.

Accordingly, the present invention contemplates the provision of continuous casting procedure of the above described type, i.e. including induction stirring with a moving magnetic field, wherein the field is produced and maintained as a field for creating stirring force, in the stirring region, that decreases gradually and progressively from a central locality of the stirring region at least to one end thereof. Thus the stirring force may decrease gradually and progressively, at least in the direction of ingot advance, to a substantially zero value at the downstream extremity of the stirring region, so as to effect gradual and progressive diminution of the circulation-causing force (acting on the molten interior of the ingot) throughout the portion of the stirring region extending downstream from the central locality thereof. In presently preferred embodiments of the invention, the produced field is further controlled to effect gradual and progressive increase of stirring force from a substantially zero value at the up stream end of the stirring region to a maximum at the aforementioned central locality, i.e. to cause the applied stirring force to rise gradually and progressively through the upstream portion of the stirring region. It will be understood that the term "stirring region" as used herein refers to the region through which the ingot, in its path of advance, is subjected to a moving magnetic field; that induction stirring as herein contemplated is stirring performed to cause longitudinally directed flow of metal in the molten pool within the ingot throughout the stirring region; and that the terms "upstream" and "downs tream" are used with reference to the direction of ingot advance from the mold. The stirring force herein considered is the component of metal-moving force, created by the magnetic field, which is oriented generally longitudinally of the ingot and which causes the above-described generally longitudinal metal flow therein.

The described provision of a magnetic field, for stirring, that creates a stirring force which decreases smoothly and gradually in a downstream direction from the central locality of the stirring region to a substantially zero terminal value (and preferably also increases smoothly and gradually from a substantially zero initial value to a maximum at the central locality of the stirring region) affords highly effective control or indeed even substantially complete elimination of problems of localized segregation by insuring that the molten interior of the advancing ingot is not subjected to abrupt termination of relatively high stirring forces as it passes through and beyond the downstream end of the stirring region; the preferred embodiments of the invention, additionally, insure against exposure of the molten ingot interior to abrupt onset of high stirring forces at the upstream end of the stirring region. Among other advantages, the procedure of the invention thus enables use of a relatively short stirring region or coil with provision of adequately high stirring force (at the central locality of the region) to achieve the desired beneficial effects of stirring, yet with avoidance of the abrupt fall-off in stirring force that would cause undesired localized segregation. This procedure also results in avoidance of formation of the cracks (i.e. gaps between dendrites) sometimes caused, at the solid-liquid interface, by overly abrupt onset and/or termination of stirring.

In this regard, it may be explained that in induction stirring as heretofore performed, for example by energization of a helical coil having equally spaced turns with polyphase alternating current of uniform magnitude throughout, the produced stirring force is at a maximum at the central locality of the stirring region defined by the coil and falls off to zero at each extremity thereof, but remains relatively high over most of the length of the stirring region and decreases abruptly adjacent each end. If the coil is sufficiently long in relation to the axial dimension of the molten pool within the ingot advancing through the coil, the progressive increase in thickness of the ingot shell in a downstream direction (resulting from progressive inward solidification of the ingot) may effect sufficient progressive attenuation of the stirring forces created by the field within the molten pool so that the forcees decrease gradually rather than abruptly in a downstream direction, thereby satisfactorily minimizing or preventing localized segregation. Moreover, if the stirring region extends downstream beyond the locality at which the ingot core becomes fully solid, there is no subjection of molten metal to abrupt termination of stirring. If, however, the stirring region is short in relation to the axial extent of the molten pool within the ingot, and terminates at a locality at which the center of the ingot is still molten, the increase in ingot shell thickness through the stirring region does not cause adequate progressive attenuation of stirring force in the downstream direction to prevent a segregation-causing abrupt termination of stirring force at the downstream extremity of the stirring region. Overly abrupt onset of high stirring force as the ingot enters the upstream end of the stirring region may also have undesired consequences, e.g. in causing localized segregation.

As may now be understood, the present invention, by controlling stirring force along the length of the stirring region in the manner described above, enables avoidance of the undesired condition of localized segregation independently of the length or position of the stirring region in relation to the molten pool within the ingot. Consequently, in the practice of the invention, a stirring region may be used (e.g. positioned beyond the outlet end of the mold, as disclosed in the above-cited patent) which has a longitudinal dimension that can be only a minor fraction of the axial extent of the molten pool within the ingot, and which terminates short of the locality of complete solidification of the ingot core, yet with advantageous freedom from localized segregation.

As a further particular feature of the invention, for optimum realization of the advantages thereof, the progressive attenuation of stirring force extends (in each direction in which it is provided, i.e. to the upstream and/or downstream extremity of the stirring region) for a distance, measured along the path of ingot advance, that is at least equal to the diameter of the stirring coil and very preferably equal to at least twice the coil diameter. Thus, stated with reference to attenuation of stirring force in the downstream direction, such attenuation should extend to the downstream end of the stirring region from a locality spaced upstream thereof (within the stirring region) by a distance equal to or greater than the stirring coil diameter. The term "coil diameter," as used herein, means the minimum internal dimension of the coil measured in a plane perpendicular to the coil axis.

Production of a magnetic field that creates a stirring force which varies smoothly and gradually in the abovedescribed manner along the length of the stirring region may be effected in a variety of ways. One form of continuous casting apparatus for the practice of the present procedure incorporates means providing a plurality of electroconductive paths (current paths) each extending generally transversely of the path of ingot advance, and disposed adjacent the ingot path throughout a predetermined zone thereof such that passage of polyphase alternating current (i.e. current having two or more phases) through the current paths produces a moving magnetic field in the latter zone with progressive decrease in number of current paths per unit length along the zone (e.g. with progressive increase in spacing between adjacent current paths) from a central locality of the zone to at least one end of the zone. Such means may, for example, comprise a helical stirring coil in which successive turns are spaced progressively further apart at least from the central portion of the coil to the downstream extemity thereof, and preferably in both directions from the central portion of the coil. Energization of the coil of polyphase (i.e. two or more phases) alternating current produces a field having the described characteristics of providing change in stirring force along the coil length. Other coil structures providing a progressive decrease in number of turns per unit length (or, alternatively, a progressive increase in radius of the turns) may also be employed, or the energizing input to the coil may be varied in an appropriate manner along the length of the stirring region, to effect the described gradual and progressive attenuation in stirring force toward one or both of the extremities of the stirring region. As used herein, the term "coil" embraces an assembly fo individually energized discrete coils disposed in succession along the path of ingot advance so as cooperatively to define a single, effectively continuous stirring region.

Further features and advantages of the invention will be apparent from the detailed description hereinbelow set forth, together with the accompanying drawings.

DETAILED DESCRIPTION

For purposes of illustration, the present invention will be described as embodied in procedure and apparatus for casting an elongated continuous ingot or strand of steel.

Figure 1:
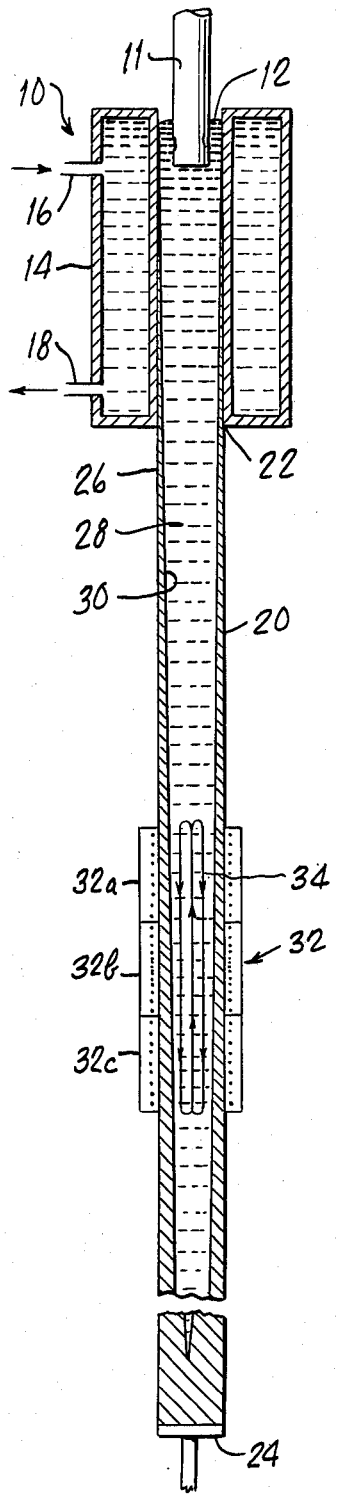
FIG. 1 is a simplified and somewhat schematic elevational sectional view of continuous casting apparatus embodying the present invention in a particular form and suitable for the practice of the present procedure.

Referring first to FIG. 1, there is shown an axially vertical open-ended casting mold 10 to which molten metal is supplied (as from a tundish, not shown) through a shroud or conduit 11 that extends downwardly into the mold through the upper end thereof and opens laterally, for discharge of metal within the mold, below the level 12 at which molten metal is maintained in the mold. Incorporated in the mold structure is a cooling jacket 14 through which a flow of liquid coolant such as water is continuously circulated, i.e. between a supply conduit 16 and outlet conduit 18, for chilling the mold to abstract heat from the contained molten metal and thereby to effect peripheral solidification of the metal within the mold.

As casting proceeds, an ingot 20 is formed within the mold and is advanced vertically downwardly through and below the open outlet end 22 of the mold, the bottom of the ingot being supported by downwardly movable support structure 24. At the point at which it emerges from the mold, the ingot 20 has a relatively thin solid outer shell 26 (produced by the above-described peripheral solidification of metal in the mold) surrounding and enclosing a pool of molten metal 28 which constitutes the central portion of the ingot. As the ingot advances downwardly from the mold, it undergoes progressive inward solidification; i.e. the shell 26 increases in thickness and the interface 30 between the solid and liquid portions of the ingot tapers progressively inwardly in a downward direction until a point is reached at which the ingot becomes fully solid. Solidification of the ingot below the mold may be promoted by application of positive cooling (not shown), in known manner. Typically, in high-speed casting of a continuous steel strand or ingot, the molten pool 28 (which constitutes the core of the emerging ingot and is continuous with the molten metal in the mold) may extend, for example, as much as 50 feet or even substantially more below the mold.

The apparatus of FIG. 1 further includes means for effecting circulation of molten metal, in the pool 28 within the ingot below the mold, by induction stirring. Specifically, a helical water-cooled induction stirring coil 32 is disposed in surrounding and coaxial relation to the path of ingot advance below the mold. The coil 32 is energized by a source of alternating current potential (not shown) such that the excitation of longitudinally successive sections of the coil (i.e. sections disposed successively along the path of ingot advance) varies in phase in a predetermined manner as will be readily understood. Any number of phases may be employed for the excitation. What is desired is a moving magnetic field which causes a flow of metal as shown by arrows 34 in FIG. 1.

That is to say, as the solidifying ingot advances downwardly in its path through the coil 32, metal of the molten pool within the ingot is subjected to the effect of the moving magnetic field produced by energization of coil 32 throughout a stirring region which is defined by (and is substantially vertically coextensive with) the coil 32.

In this regard, it may be explained that the stirring of molten metal by electromagnetic means is well known. The stirring mechanism involves development of induced currents within the molten metal by the varying magnetic field. These induced currents themselves set up magnetic fields which interact with the applied magnetic field to cause movement of the molten metal. By using polyphase excitation of longitudinally successive sections of the coil 32 in the apparatus of FIG. 1, pulses of motive force are given to the molten metal progressively from section to section in the desired direction, so that the metal is caused to flow continuously downward along its outermost regions, in effect parallel to the axis of the coil. As shown by arrows 34, the flow of molten metal sweeps downwardly over the solid/liquid interface of the ingot and upwardly through the center of the molten pool. By appropriate reversal of the phases of excitation of the coil sections, an opposite flow could be achieved with respect to that shown in FIG. 1; however, at least in many instances, the pattern of longitudinally directed flow illustrated in FIG. 1 is preferred.

As will now be apparent, the moving magnetic field produced and maintained by the described energization of the coil creates a stirring force, within the molten interior of the ingot, having a component directed generally longitudinally of the ingot (i.e. generally parallel to the ingot axis). The term "stirring force," as used herein, will be understood to refer to this longitudinal component of stirring force, which causes the longitudinally directed sweeping flow of molten metal along the solid-liquid interface.

The arrangement and operation of the continuous casting apparatus of FIG. 1, including the induction stirring means as thus far described, are generally as disclosed in the above-cited U.S. Pat. No. 3,693,697, to which reference may be made for a detailed explanation of the specific effects and advantages of the longitudinally directed induction stirring, e.g. with respect to attainment of desired ingot microstructure and consequent avoidance or control of various problems that might otherwise be encountered incident to solidification of a continuously cast ingot. It may be noted, however, that in contrast to the preferred embodiments of the invention disclosed in the cited patent, the axial dimension of the stirring region (i.e. the region throughout which the moving magnetic field is produced) in the present FIG. 1 can be a minor fraction of the axial extent of the molten pool 28, and the stirring region terminates substantially above the locality of complete solidification of the ingot. The significance of these differences will be hereinafter further explained.

Figure 2:
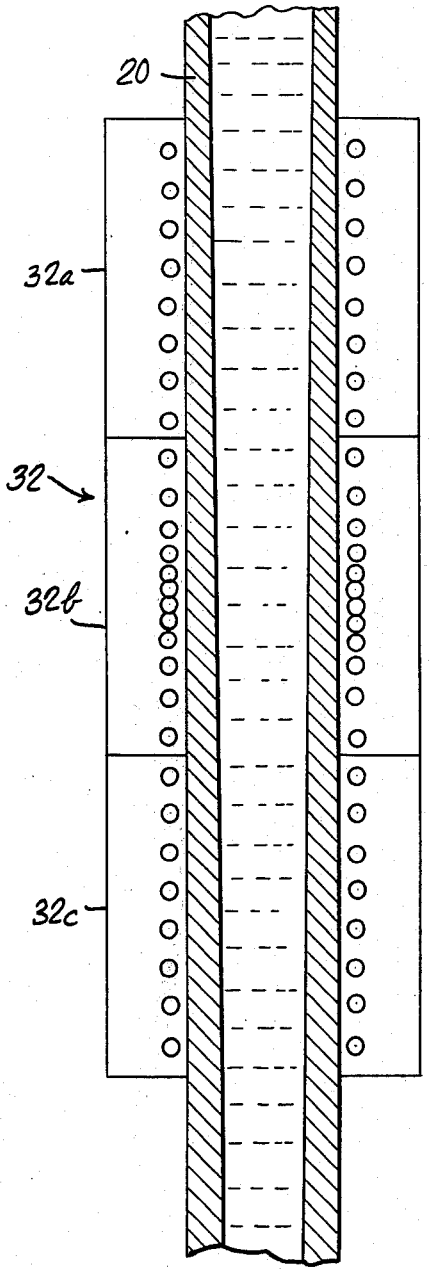
FIG. 2 is a diagrammatic representation of the spacing between adjacent turns of the stirring coil in the apparatus of FIG. 1, as viewed in elevation.

In accordance with the present invention (and in contrast with prior practice utilizing a helical induction stirring coil having substantially equally spaced turns), the turns in the upper and lower portions of coil 32 are spaced substantially further apart from each other than are the turns in the central portion of coil 32. Specifically, the spacing between adjacent turns at the upper or upstream end of the upper portion **32*a* of coil 32 is at a first maximum, and the spacing between turns decreases progressively in a downstream direction to the middle of the central portion 32*b* of the coil, where the interturn spacing reaches a minimum. Thereafter, continuing in a downstream direction, the spacing between successive adjacent turns of the coil increases progressively until a second maximum spacing between adjacent turns is reached at the lower or downstream end of the lower portion 32***c* of the coil. This arrangement of spacing between adjacent coil turns is illustrated diagrammatically in FIG. 2.

Stated in other words, considering the coil as divided into three sections 32*a*, 32*b* and 32*c* of equal axial extent, disposed in succession along the path of ingot advance, the central section 32*b* has more coil turns, with closer spacing between adjacent turns, than either of the coil sections 32*a* and 32*c*, and there is a regular and progressive increase in spacing between adjacent coil turns, both upstream and downstream from the middle of the center section 32*b*, to the upper and lower extremities of the coil. Since, for a given magnitude of energizing current, the stirring force created by the magnetic field produced by energization of the coil is directly related to the number of turns in the coil per unit length, energization of the coil represented digrammatically in FIG. 2 (with polyphase alternating current of substantially uniform magnitude throughout the length of the coil) produces a magnetic field that creates a stirring force which increases smoothly and gradually from a substantially zero value at the upper or upstream extremity of the coil to a maximum value at the center of the coil, and then (continuing in a downstream direction) decreases again smoothly and gradually from the central maximum to a substantially zero value at the lower or downstream extremity of the coil.

Thus in continuous operation in the apparatus of FIG. 1, molten metal of the pool 28 entering the upstream extremity of the stirring region defined by coil 32 encounters gradually increasing stirring force rather than (as in prior practice) an abrupt onset of high stirring force. Similarly, as the metal descends through and beyond the central loclity of the stirring region to the downstream end thereof, it is subjected to stirring force that decreases smoothly and gradually from a maximum at the central locality to a substantially zero value at the downstream end of the stirring region, rather than being subjected to an abrupt termination of intense stirring as in prior practice.

The avoidance of abrupt onset, and especially the avoidance of abrupt termination, of high stirring force within the stirring region is found to have the effect of minimizing or indeed eliminating the problems, including localized segregation, heretofore associated with induction stirring with a relatively short coil or stirring region terminating above the locality of complete solidification of the ingot. At the same time, with appropriately close spacing of coils in the central locality of the stirring region, a sufficiently high stirring force may be achieved to enable satisfactory attainment of the benefits of induction stirring. Thus the present invention enables use of a short coil or stirring region (i.e. having an axial extent which may be only a minor fraction of the axial extent of the molten pool in the ingot) terminating well above the locality of complete ingot solidification. For many purposes, use of such a short coil, thus disposed, is advantageous especially for the sake of convenience, economy and simplicity of construction and operation of continuous casting apparatus.

In summary, then, the practice of the present procedure with the apparatus of FIG. 1 involves supplying molten metal to the mold 10 in a progressive or continuous manner while continuously advancing the metal downwardly through an below the mold outlet end 22 as an ingot 20 having a solid outer shell 26 and a central pool of molten metal 28, and causing a circulating flow of molten metal within the pool as indicated by arrows 34 by application of stirring force created by a moving magnetic field extending throughout the stirring region defined by coil 32 in the path of ingot advance. In this procedure, the magnetic field is produced and maintained (by energization of the coil, having the gradually changing spacing between adjacent turns described above) as a field for creating stirring force that decreases gradually and progressively from the central locality of the stirring region to a substantially zero value at each end thereof.

Figure 3:
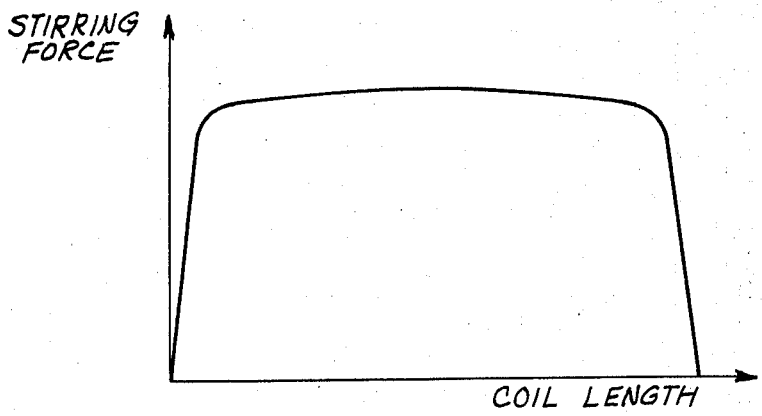
Fig. 3. (PRIOR ART)
FIG. 3 is a graph showing axial stirring force as a function of position along the length of the coil in a typical prior art induction stirring operation of the general type with which the present invention is concerned.
Figure 4:
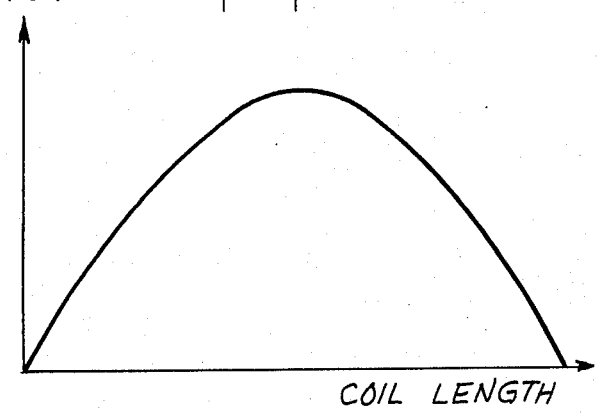
FIG. 4 is a graph similar to FIG. 3 showing axial stirring force as a function of position along the length of the coil in practice of the present casting procedure with the apparatus of FIG. 1.

The relation between stirring force and position along the length of the stirring region, in the procedure of the present invention, may be further understood with reference to FIGS. 3 and 4. FIG. 3 shows the stirring force (along the axis of an energized induction stirring coil) created by the magnetic field produced by energization of a stirring coil having equally spaced turns throughout its length, with the $x$ axis representing distance along the axis of the coil from the upstream end (zero intercept). As there represented, the stirring force in such prior practice (depending on the length of the coil) rises very rapidly adjacent the upstream end of the coil to a relatively high value, which is thereafter maintained almost all the way to the downstream end of the coil with a very slight further rise to a maximum at or adjacent a central locality of the coil and a correspondingly very slight decline downstream of that central locality. Adjacent the downstream end of the coil, stirring force drops very suddenly back to a zero value.

FIG. 4 is a graph similar to FIG. 3 showing the stirring force created by the magnetic field produced in the present procedure as performed with the apparatus of FIG. 1 having a coil in which the spacing between turns increases progressively from a central locality to each end of the coil. In contrast to the situation in FIG. 3, the stirring force in FIG. 4 rises smoothly and gradually from a substantially zero value at the upstream end of the coil to a maximum at the central locality and then decreases smoothly and gradually to a substantially zero value at the downstream end of the coil. There is no abrupt decrease in stirring force adjacent either end of the coil. Although the maximum stirring force achieved in the central locality may, for example, be comparable in magnitude to that achieved in the operation represented by FIG. 3, the stirring force at other points approaching each end of the coil is generally substantially less than in FIG. 3.

Figure 5:
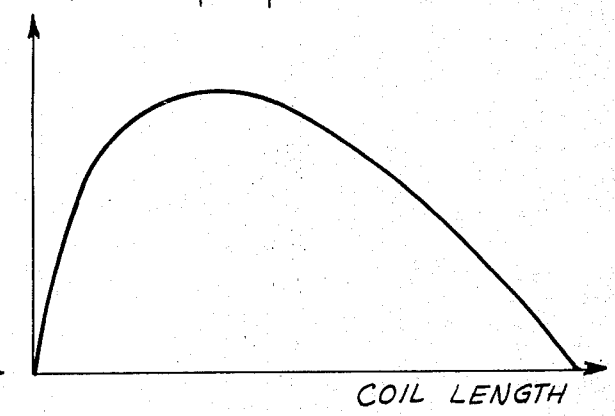
FIGS. 5 and 5*a* are further similar graphs showing the variation of axial stirring force along the length of the coil in alternative embodiments of the procedure of the present invention.

FIG. 5 is another similar graph illustrative of an alternative embodiment of the invention wherein the magnetic field is produced as a field for creating stirring force that increases rapidly adjacent the upstream end of the coil (but not as rapidly as in the prior practice represented by FIG. 3) to a maximum value at or slightly upstream of the center point of the coil, but decreases smoothly and gradually in a downstream direction at least from the center point of the coil to a substantially zero value to the downstream end thereof. The field for creating the stirring force represented by FIG. 5 may be produced, for example, by appropriate polyphase alternating current energization of a helical coil having equally spaced turns in its upstream portion and progressively increased spacing between adjacent turns in its downstream portion. Procedure including production of a field for creating the stirring force represented in FIG. 5 again avoids abrupt termination of high stirring forces and consequent localized segregation in the ingot being cast.

Figure 5A:
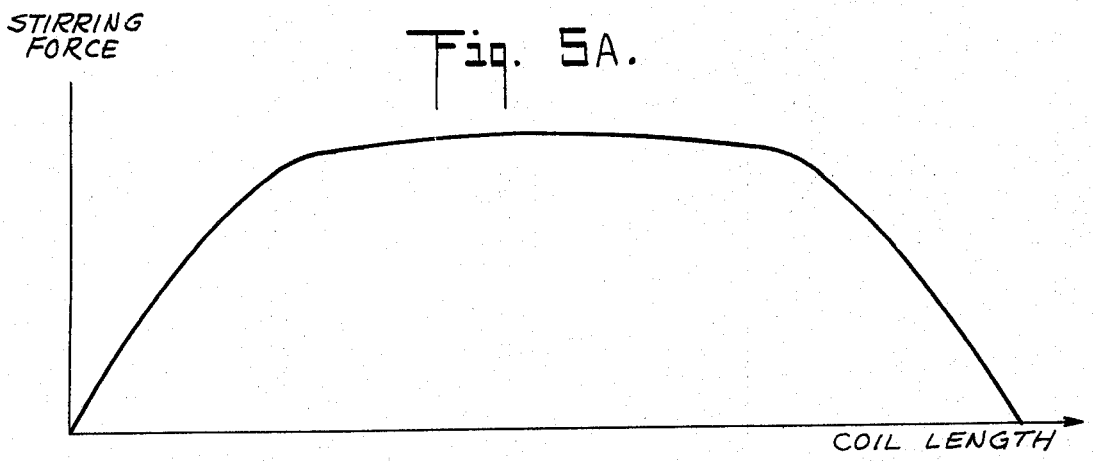

FIG. 5A illustrates the practice of the invention in a relatively elongated stirring region. The stirring force rises gradually and progressively from a substantially zero value at the upstream end of the stirring region, and is maintained at a high value throughout an axially extended central portion of the stirring region, decreasing again gradually and progressively to a substantially zero value at the downstream end thereof. That is to say, as represented by FIG. 5A, the stirring force may be maintained at a high value for an extended distance along the path of ingot advance so long as the onset and termination of stirring force are gradual and progressive. It will be understood that terms such as center portion or central locality of the coil or stirring region refer to the portion of the coil or region intermediate (and spaced inwardly from) the opposite extremities thereof, i.e. in the direction of the coil axis. When a sufficiently long stirring region is used, the central locality may itself be axially extended, as indicated in FIG. 5A.

Further in accordance with the invention, the axial distance over which the stirring force is progressively attenuated, between the central locality of the stirring region and the downstream extremity thereof, is at least equal to (preferably at least twice) the diameter of the coil; and the axial extent of upstream attenuation of stirring force is of like magnitude. That is to say, in the practice of the procedure of the invention with the apparatus of FIG. 1, the moving magnetic field is produced and maintained as a field for creating stirring force that decreases gradually and progressively from the central locality of the stirring region to the upstream and downstream and downstream extremities of the stirring region, respectively, over axial distances each at least equal to the coil diameter. In this way, and especially when the zones or portions of the stirring region in which stirring force is progressively attenuated are each at least equal to twice the coil diameter, adequately gradual decrease of stirring force is achieved to assure desired freedom from localized segregation.

As stated, in presently preferred embodiments, the invention contemplates provision of a stirring region, in continuous casting procedure and apparatus, which is disposed beyond the casting mold but extends for only a fraction of the axial dimension of the molten pool within the ingot beyond the mold. It is found that a short stirring region, disposed entirely upstream of the location at which the ingot becomes completely solidified, affords fully adequate control of such structural defects in the ingot as center shrinkage, segregation, and columnar growth for many casting operations, as well as being more convenient and economical than arrangements which provide stirring over substantially the full length of the molten pool in the ingot beyond the mold, i.e. when the short stirring region is provided in a manner that embodies the features of gradual variation in field intensity over the length of the region whereby localized segregation is avoided.

Figure 6:
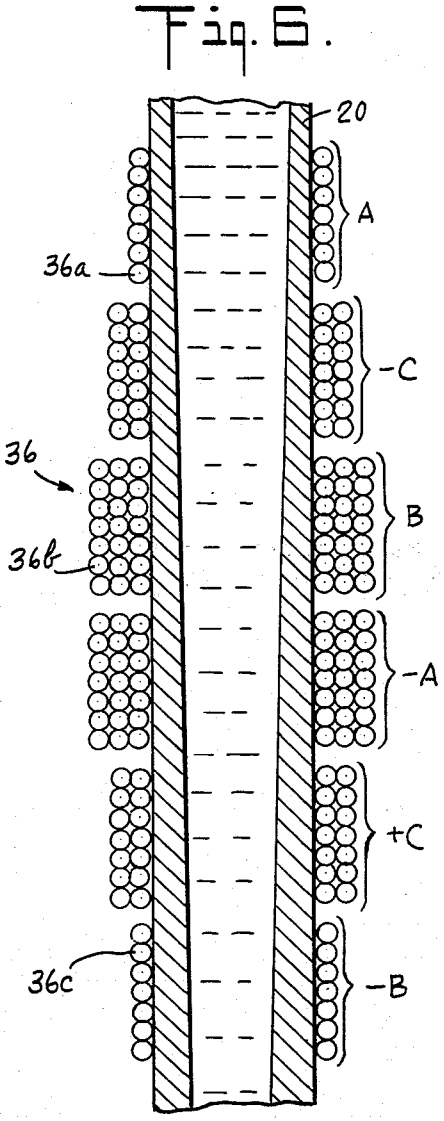

It will be understood that the described use of a coil having gradually varying spacing between turns is merely illustrative of the ways in which the field, for creating stirring force that varies along the length of the stirring region, may be produced. For example, the stirring coil 36 illustrated schematically in FIG. 6 provides variation in field intensity from end to end of the stirring region by decreasing the ampere-turns per unit length (along the coil axis) from the central portion 36*b* of the coil through the upstream and downstream portions 36*a* and 36*c* thereof, without varying the spacing between turns. The FIG. 6 coil, as shown, has a multilayer winding in its central portion, and the number of layers of winding is reduced progressively or stepwise toward each end.

Figure 7:
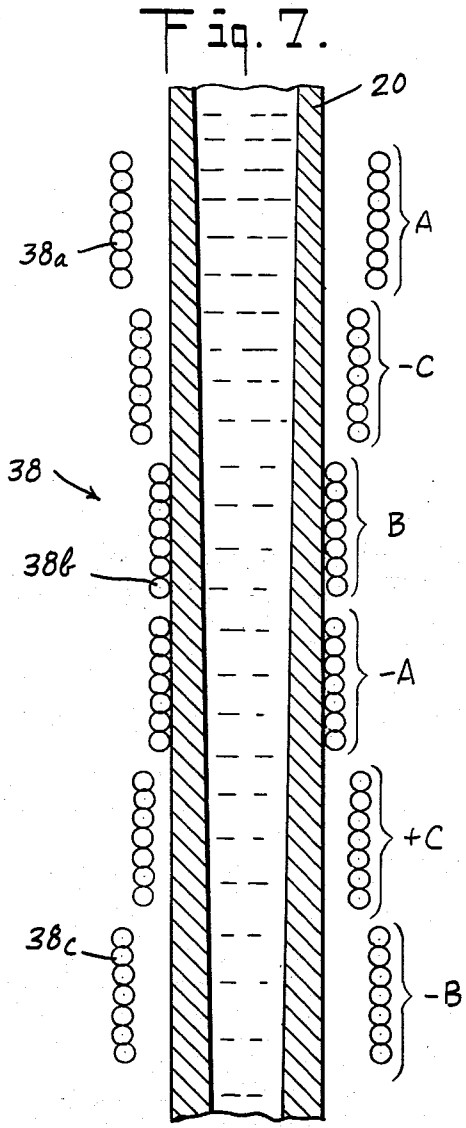

Alternatively, the coil may be of the form shown at 38 in FIG. 7, with equally spaced turns of progressively increasing radius toward each end of the coil. The radius of the turns is thus at a minimum in the central coil portion 38*b*, and increases stepwise (away from the central portion) through upper and lower portions 38*a* and 38*c*. In this FIG. 7 coil, the increasing radius of the turns lowers the efficiency of the ends of the coil as compared with the efficiency in the central portion.

The coils of FIGS. 6 and 7 are, as represented, six-phase coils, excited with phase currents of substantially equal value throughout. Progressive attenuation of stirring force toward each end of the coil is provided (as in the case of the FIG. 2 coil, already described) by the configuration of the coil itself.

Figure 8:
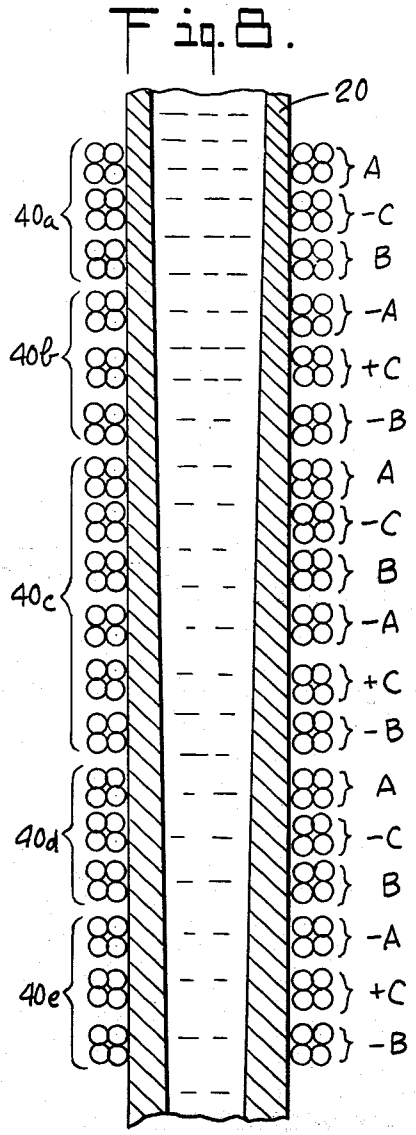
FIGS. 6, 7 and 8 are representations similar to FIG. 2 illustrating alternative coil arrangements suitable for the practice of the invention.

The same result (progressive attenuation of stirring) may also be provided by appropriate variation in input excitation, for example in a coil assembly of the type shown at 40 in FIG. 8, which comprises a plurality of six-phase coils disposed along a common axis, each coil having the same uniform number of turns per unit length throughout. With this coil assembly, the ampere-turns per unit length may be varied over the length of the stirring region by progressively decreasing the amperage of the excitation current toward the ends of the assembly. Thus, if the central portion 40*c* of the coil is energized with current of I amperes, the adjacent upper and lower coil portions 40*b* and 40*d* may be energized with current equal to 80% I, and the end portions 40*a* and 40*e* may be energized with current equal to 60% I. As a still further alternative, the upper and lower portions of the coil assembly may be energized with current of progressively higher frequency than the current used to energize the central portion of the assembly, utilizing the known phenomenon that in induction stirring of the general type herein contemplated, increase in excitation frequency may result in decrease in stirring force.

It will be understood that in FIGS. 6, 7 and 8, the letters A, −A, B, −B, +C, and −C designate the phases of current with which successive sections of the coil are respectively excited, as indicated.

Although helical coils have been shown and described herein for purposes of illustration, it will be appreciated that other coil configurations suitable for creating stirring forces to cause longitudinally directed molten metal circulation within an advancing ingot may alternatively be employed, i.e. with the turns of such coils arranged and/or energized to provide gradual and progressive onset and/or termination of stirring force.

By way of further and more specific illustration of the invention, in an example of casting apparatus of the type shown in FIG. 1, a coil 32 is used having an overall axial dimension of 42 inches, with its upstream end disposed five feet below the outlet of the mold 10. The upper section 32*a* of the coil comprises 10 turns having a spacing of 1⅜ inch between the uppermost two turns, and a progressive decrease of ⅛ in spacing between adjacent turns, proceeding in a downward direction. The axial length of section 32*a* is 14 inches.

The central section 32*b* of the coil comprises twenty turns with a constant 1/16-inch reduction in spacing for the uppermost two coil turns in this section, a further 1/16-inch reduction in spacing for the next two coil turns, etc., throughout the first 10 turns of section 32*b;* for the remaining 10 turns of section 32*b*, the spacing arrangement is reversed so that the turns are spaced progressively farther apart for the downstream direction. This section also has an axial extent of 14 inches.

The final lowermost coil section 32*c*, also 14 inches long, has 10 turns with a spacing arrangement that is a mirror image of section 32*a;* i.e. successive turns are spaced apart with successive increments to the downstream end of the coil.

It is to be understood that the invention is not limited to the features and embodiments hereinabove specifically set forth but may be carried out in other ways without departure from its spirit.

We claim:

1. Continuous casting procedure comprising a. supplying molten metal to a cooled mold having an open outlet end while b. advancing the metal in one direction through and beyond the mold outlet end as an ingot having a solid outer shell and a central pool of molten metal cooperatively defining a solid-liquid interface that tapers inwardly in said one direction, and c. causing, by application of stirring force created by a moving magnetic field in the path of ingot advance throughout a stirring region having upstream and downstream extremities spaced apart in said one direction, a circulating flow of molten metal within said pool that sweeps along said interface in a direction substantially parallel to said one direction, while d. producing and maintaining said magnetic field as a field for creating stirring force, in the stirring region, that decreases gradually and progressively in at least one direction from a central locality of said region to a substantially zero value at least at one extremity of said region for effecting gradual and progressive diminution of circulation-causing force in said pool in said one direction throughout the portion of said region extending to said one extremity from the central locality thereof.

2. Procedure according to claim 1, wherein the field-producing step comprises producing a field for creating stirring force that increases gradually and progressively, in a downstream direction, from a substantially zero value at the upstream extremity of the stirring region, to a maximum at said central locality, and then decreases gradually and progressively as aforesaid from the central locality to the downstream extremity of the stirring region.

3. Procedure according to claim 1, wherein the stirring region is disposed downstream of the outlet end of the mold and the downstream extremity of the stirring region is disposed upstream of the locality at which the center of the ingot becomes fully solidified.

4. Procedure according to claim 3, wherein the length of the stirring region, along the ingot, is a minor fraction of the extent of the pool along the axis of the ingot beyond the mold.

5. Procedure according to claim 1, wherein the field-producing step comprises passing alternating current, supplied to have at least two different phases in longitudinally successive portions of the stirring region, along a plurality of spaced current paths each extending generally transversely of the ingot in adjacent relation thereto and disposed in succession throughout the stirring region with the spacing between adjacent current paths progressively increasing from the central locality of the stirring region at least to the downstream extremity thereof.

6. Procedure according to claim 5, wherein the spacing between adjacent current paths also increases progressively from the central locality of the stirring region to the upstream end thereof.

7. Procedure according to claim 1, wherein the field-producing step comprises exciting, with alternating current supplied to have at least two different phases in longitudinally successive portions of the stirring region, a coil disposed in surrounding relation to the path of ingot advance at said stirring region and comprising a plurality of turns distributed along the stirring region such that the number of turns per unit length along the stirring region decreases progressively from a central locality of the stirring region to the downstream extremity thereof.

8. Procedure according to claim 1, wherein the field-producing step comprises exciting, with alternating current supplied to have at least two different phases in longitudinally successive portions of the stirring region, a coil disposed in surrounding relation to the path of ingot advance at said stirring region and comprising a plurality of turns distributed along the stirring region and having progressively increasing radii from a central locality of the stirring region to the downstream extremity thereof.

9. Procedure according to claim 1, wherein the field-producing step comprises passing alternating current, supplied to have at least two different phases in longitudinally successive portions of the stirring region, and progressively decreasing in value from a central locality of the stirring region and the downstream extremity thereof, along a plurality of current paths each extending generally transversely of the ingot in adjacent relation thereto and distributed along the stirring region.

10. Procedure according to claim 1, wherein the field-producing step comprises passing alternating current, supplied to have at least two different phases in longitudinally successive portions of the stirring region, and progressively increasing in frequency from a central locality of the stirring region and the downstream extremity thereof, along a plurality of current paths each extending generally transversely of the ingot in adjacent relation thereto and distributed along the stirring region.

11. Continuous casting procedure comprising a. supplying molten metal to a cooled mold having an open outlet end while b. advancing the metal in one direction through and beyond the mold outlet end as an ingot having a solid outer shell and a central pool of molten metal cooperatively defining a solid-liquid interface that tapers inwardly in said one direction, and c. causing, by application of stirring force created by a moving magnetic field in the path of ingot advance throughout a stirring region having upstream and downstream extremities spaced apart in said one direction, a circulating flow of molten metal within said pool that sweeps along said interface in a direction substantially parallel to said one direction, while d. producing and maintaning said magnetic field, by exciting a coil disposed in surrounding relation to the path of ingot advance at said stirring region with alternating current supplied to have at least two different phases in longitudinally successive portions of the stirring region, as a field for creating stirring force, in said stirring region, that decreases gradually and progressively from a central locality of the stirring region to at least one extremity thereof over a distance, measured along the path of ingot advance, at least equal to the diameter of said coil.

12. Procedure according to claim 11, wherein said distance over which the stirring force progressively decreases is at least equal to twice the diameter of said coil.

13. Continuous casting apparatus including a. an open-ended ingot casting mold;

b. means for supplying molten metal to the interior of the mold;

c. means for cooling the mold to effect peripheral solidification of metal contained therein;

d. means for advancing metal from the mold along a path extending through and beyond the open end thereof as an ingot having a solid outer shell with a central pool of molten metal and a solid-liquid interface that tapers progressively inward in the direction of ingot advance; and e. helical coil disposed in substantially coaxial surrounding relation to the path of the advancing ingot, having upstream and downstream ends and comprising a plurality of turns, energizable with alternating current supplied to have at least two different phases in longitudinally successsive portions of the coil, for producing a moving magnetic field that acts on molten metal in the pool within the ingot to cause longitudinally directed flow of molten metal along said interface;

wherein the improvement comprises f. said coil having a number of turns per unit length along the axis of said coil that decreases progressively in a downstream direction from a central locality of said coil to the downstream end thereof.

14. Apparatus as defined in claim 13, wherein the number of turns per unit length along the axis increases progressively from the upstream end of said coil to the central locality thereof.

15. Apparatus as defined in claim 13, wherein successive adjacent turns of said coil are spaced apart by amounts increasing progressively from a central locality of said coil to the downstream end thereof.

16. Apparatus as defined in claim 15, wherein successive adjacent turns of said coil are spaced apart by amounts decreasing progressively from the upstream end of said coil to the central locality thereof.

17. Continuous casting apparatus including a. an open-ended ingot casting mold;

b. means for supplying molten metal to the interior of the mold;

c. means for cooling the mold to effect peripheral solidification of metal contained therein;

d. means for advancing metal from the mold along a path extending through and beyond the open end thereof as an ingot having a solid outer shell with a central pool of molten metal and a solid-liquid interface that tapers progressively inward in the direction of ingot advance; and e. helical coil disposed in substantially coaxial surrounding relation to the path of the advancing ingot, having upstream and downstream ends and comprising a plurality of turns, energizable with alternating current supplied to have at least two different phases in longitudinally successive portions of the coil, for producing a moving magnetic field that acts on molten metal in the pool within the ingot to cause longitudinally directed flow of molten metal along said interface;

wherein the improvement comprises f. the turns of said coil having progressively increasing radii in downstream direction from a central locality of the coil to the downstream end thereof.

18. Apparatus as defined in claim 17, wherein the turns of said coil have progressively decreasing radii from the upstream end to the central locality of said coil.

19. In casting apparatus wherein an elongated metal ingot having a solid outer shell and a molten core is advanced along a defined path while undergoing progressive inward solidification, a device for creating longitudinally directed circulating flow of molten metal within the advancing ingot by induction stirring, said device including a. stirring means providing a plurality of electroconductive paths each extending generally transversely of the path of ingot advance, said conductive paths being disposed in successive spaced relation along and adjacent a predetermined zone of said path of ingot advance; and b. means for passing, along said conductive paths, alternating current supplied to have at least two different phases in longitudinally successive portions of said zone, for producing throughout said zone a moving magnetic field acting on an ingot advancing therethrough to effect circulating flow of molten metal within the ingot as aforesaid;

wherein the improvement comprises c. successive adjacent conductive paths of said stirring means being spaced apart by distances that increase progressively from a central locality of said zone to at least one end of said zone.

* * * * *